United States Patent [19]

Sun

[11] 4,283,098

[45] Aug. 11, 1981

[54] ATTACHE CASE HAVING DRAWER APPARATUS

[76] Inventor: Liang-Hung Sun, 5th Fl., No. 4-1, Lane 186, Tung-Hua St., Taipei, Taiwan

[21] Appl. No.: 77,003

[22] Filed: Sep. 19, 1979

[51] Int. Cl.[3] ..... A47B 88/20

[52] U.S. Cl. ..... 312/319; 312/DIG. 33; 312/244; 312/333

[58] Field of Search ..... 312/DIG. 33, 333, 319, 312/244, 242, 223

[56] References Cited

U.S. PATENT DOCUMENTS

| | | | |
|---|---|---|---|
| 2,755,154 | 7/1956 | Mele | 312/319 |
| 3,019,070 | 1/1962 | Diebold | 312/319 |
| 3,592,521 | 7/1971 | Cox | 312/319 |

*Primary Examiner*—Casmir A. Nunberg

[57] ABSTRACT

An improved attache case comprises a base, a cover hinged to said base, a drawer apparatus provided in a chamber of the cover for containing the small articles and a driving means also provided in the chamber of the cover to engage with the drawer apparatus for controlling the moving of the drawer apparatus. The driving means may have a plurality of embodiments if they may achieve the function to move the drawer apparatus.

6 Claims, 5 Drawing Figures

ATTACHE CASE HAVING DRAWER APPARATUS

BACKGROUND OF THE INVENTION

1. Field of the Invention

The present invention relates to an improved attache case with drawers provided therein.

2. Brief Description of the Prior Art

The conventional attache cases have no drawer apparatus provided therein for the users to take out something from the attache case without opening the cover thereof. Usually the documents and articles of importance are contained in the attache case along with the personal private things or other small articles such as cigarettes, lighter and glasses. If the user wants to take out any thing from the attache case, the cover of the case must be opened once. It is especially inconvenient to do so when the attache case is locked. Therefore a drawer apparatus in the attache case for containing the small articles which have to be taken from time to time is indeed necessary.

SUMMARY OF THE PRESENT INVENTION

It is the main object of the present invention to provide a drawer apparatus in an attache case for containing the small articles enabling the users to take out something from the case without opening the cover of the case.

Another object of the present invention is to provide a driving means which can automatically open or close the drawers in the attache case.

According to the present invention, the improved attache case comprises a base, a cover hinged to said base, a drawer apparatus provided in a chamber of the cover for containing the small articles and a driving means also provided in the chamber of the cover to engage with the drawer apparatus for achieving the open and close thereof. The driving means comprises a reversible moter using a battery as its power supply, a gear track attached to the drawer apparatus engaging with the motor, and a switch to control the rotation of the motor therefore further control the open and close of the drawer apparatus. The driving means may have another embodiment comprising a plurality of springs attached to the drawer apparatus as the driving energy source, a hook plate having a hook tip cooperating with the drawer apparatus and mounted on an U-shaped frame, and a driving rod to be operated to control the driving means therefore further control the open of the drawer apparatus.

BRIEF DESCRIPTION OF THE DRAWINGS

Those and other objects, features and advantages of the present invention will become apparent from the following detailed description of the preferred embodiment with reference to the accompanying drawings.

DETAILED DESCRIPTION OF THE PREFERRED EMBODIMENT

Figure 1:
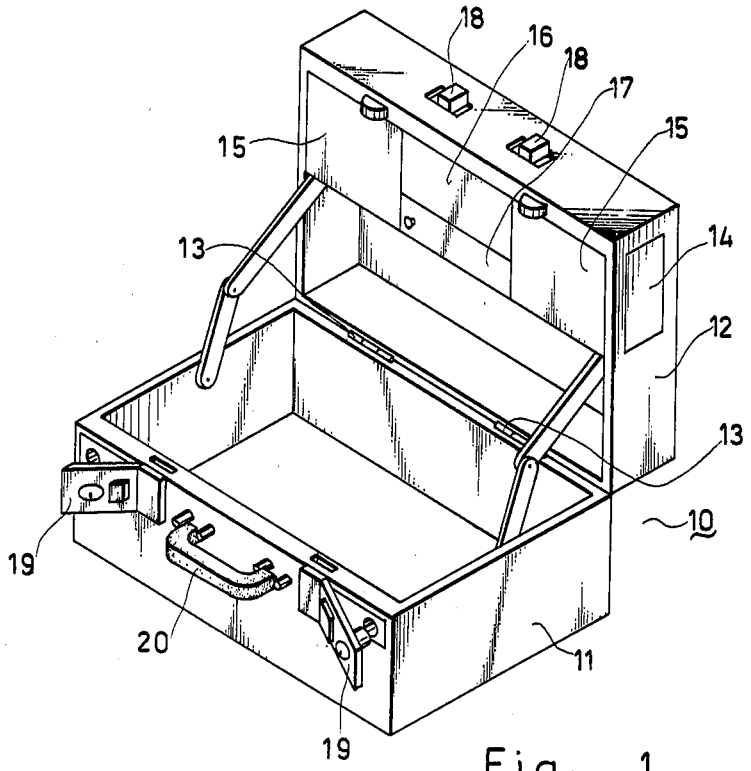
FIG. 1 is a perspective view of the improved attache case having a drawer apparatus according to the present invention.

Referring to FIG. 1 which shows a perspective view of the improved attache case of the present invention, the attache case 10 comprises a base 11, a cover 12 connected to the base 11 with a pair of hinges 13, a pair of drawer apparatus 14 contained in a chamber formed by the plate 15 and the cover 12, a driving means (not shown in FIG. 1) contained in another chamber formed by the plates 16, 17 and the cover 12, a pair of switches 18 to control the driving means, and other necessary equipments such as locks 19, handle 20, etc.. It is to be noted that the batteries used for the power supply of the driving means are contained in the chamber formed by the plate 17 and the cover 12 and are not shown in the figures. The switches 18 are normally open and can be pushed in either direction to control the rotation direction of the motor.

Figure 2:
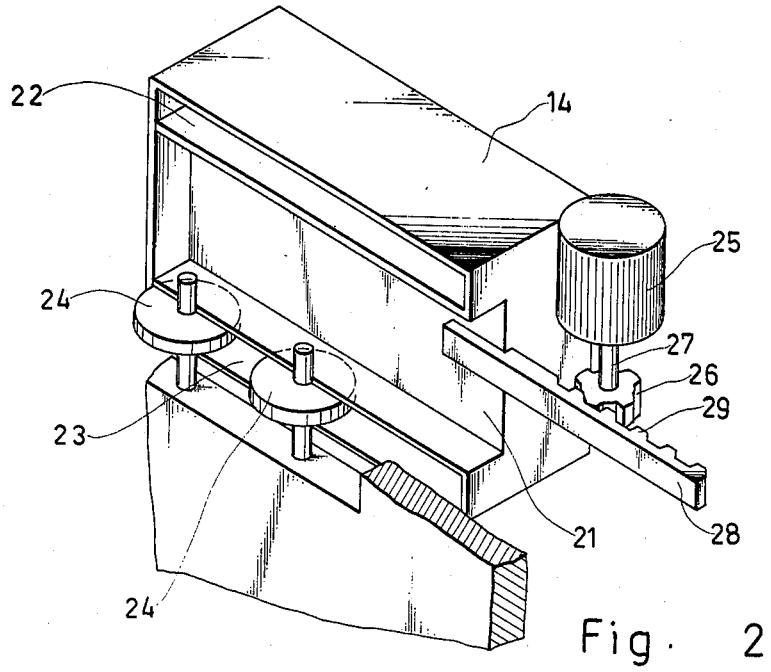
FIG. 2 is a perspective view of the drawer apparatus and the driving means in the attache case according to the present invention.

Referring to FIG. 2 which shows a perspective view of the drawer apparatus and the driving means of the present invention, the drawer apperatus 14 is in the shape of a box having a recess 21 formed on the bottom face thereof and a pair of track recesses 22, 23 for engaging with the rolling wheels 24. The driving means comprises a reversible motor 25 with a gear 26 installed on the rotating axis 27 of the motor 25 and a gear track 28 connected to the drawer apparatus 14 with the gear teeth 29 cooperating with the gear 26 on the motor 25.

In operation, the user pushes the switch 18 on the attache case 10 to make the reversible motor 25 start to rotate and the drawer apparatus 14 will move out of the attache case 10 due to the operation of the gear 26 and the gear track 28. The drawer apparatus 14 will stop when the user releases the switch 18. And the user may easily take out the small things contained in the drawer apparatus without opening the cover of the attache case.

Figure 3:
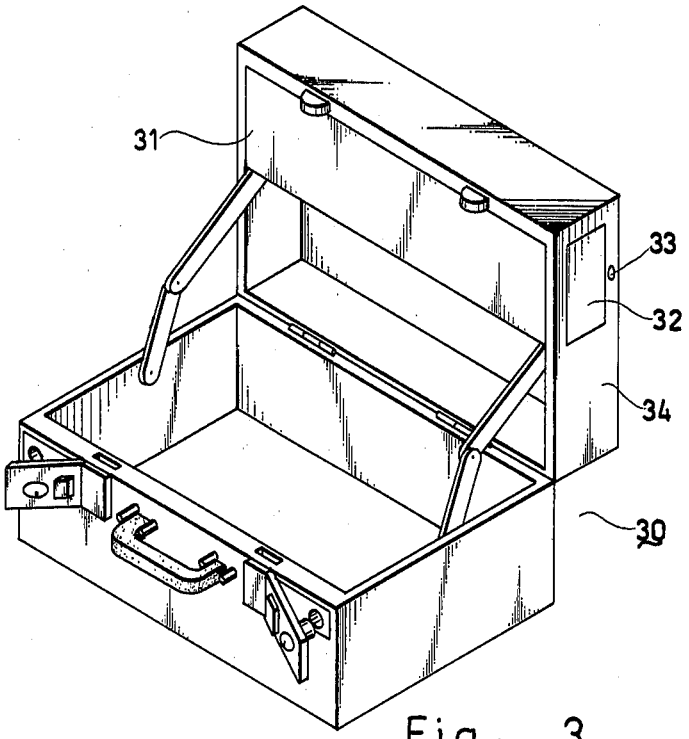
FIG. 3 is a perspective view of another embodiment of the improved attache case having a drawer apparatus according to the present invention.

FIG. 3 shows another embodiment of the improved attache case having a drawer apparatus of the present invention. The attache case 30 has a same structure as that is shown in FIG. 1 except there is only one plate 31 to form chambers for containing the drawer apparatus 32. There may be one or two drawer apparatuses 32 installed in the attache case. A push botton 33 is equipped on the side 34 of the attache case 30 for controlling the opening of the drawer apparatus 32.

Figure 4:
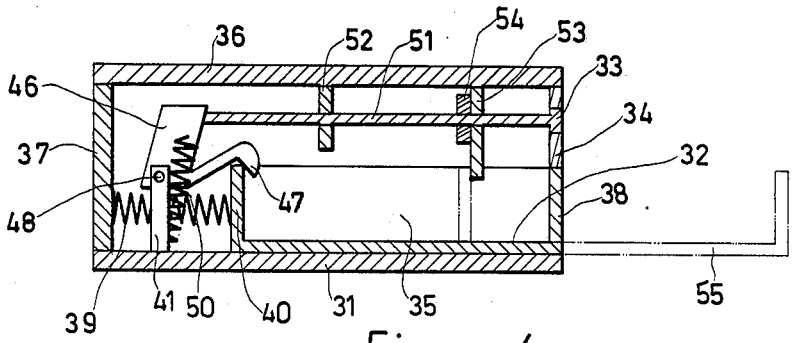
FIG. 4 is a sectional view of the drawer apparatus and the driving means in the attache case according to the present invention.
Figure 5:
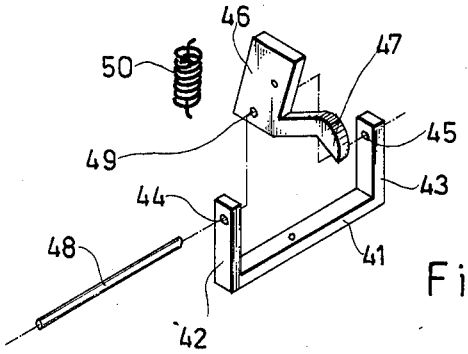
FIG. 5 is an exploded view of the driving means in the attache case according to the present invention.

The drawer apparatus and the driving means of the improved attache case is bset shown in FIGS. 4 and 5 where FIG. 4 is a sectional view of the drawer apparatus and the driving means and FIG. 5 is an exploded view of the driving means. The drawer apparatus 32 is contained in the chamber 35 formed by the plate 31, the cover 36 and the isolation plate 37. The outer face 38 of the drawer apparatus 32 aligns with the side 34 of the attache case 30 when the drawer is closed. There are a plurality of springs 39 connected between the end 40 of the drawer apparatus 32 and the isolation plate 37, which are compressed when the drawer is in its closed position as shown in the figure. A U-shaped frame 41 is attached to the plate 31 having two supports 42, 43 with openings 44, 45 formed respectively thereon. A hook plate 46 having a hook tip 47 is mounted on said U-shaped frame 41 by a pin 48 passing through the hole 49 of the hook plate 46. A spring 50 is connected between the hook plate 46 and the U-shaped frame 41 to make the hook tip 47 grasp the end 40 of the drawer apparatus 32. A controlling rod 51 with its one end formed into the push botton 33, is supported by two supporters 52, 53. The other end of the controlling rod 51 is in touch with the hook plate 46. A stopper 54 is formed on the controlling rod 51 to prevent the same from extending from the side 34 of the attache case 30.

In operation, the user only has to press the push botton 33 making the hook plate 46 to rotate counterclockwise and thereafter the hook tip 47 releases the end 40 of the drawer apparatus 32. The drawer apparatus 32 will be pushed by the springs 39 to move out of the attache case 30 to a position as shown by the dotted line 55. If the drawer apparatus is to be collected again, the user just has to press the drawer apparatus from the outer face 38 thereof making the end 40 of the drawer apparatus 32 to be grasped by the hook tip 47 again.

Although the invention has been described in its preferred form with a certain degree of particularity, it is to be understood that the present disclosure of the preferred form has been changed in the details of construction and the combination and arrangement of parts may be resorted to without departing from the spirit and the scope of the invention as hereinafter claimed.

What is claimed is:

1. An improved attache case comprising:

(a) a base, (b) a cover hinged to said base and defining a first compartment, (c) a drawer apparatus provided in a chamber of said cover and defining a second compartment, and (d) a driving means also provided in said chamber of the cover to engage with the drawer apparatus for controlling the moving and opening of the drawer apparatus, said cover and said driving means being independently operable to permit access to said first and second compartments.

2. An improved attache case as claimed in claim 1 wherein said drawer apparatus further comprising a pair of track recesses engaging with the rolling wheels in the cover.

3. An improved attache case as claimed in claim 2 wherein said drawer apparatus further comprising a gear track attached on the bottom face thereof for engaging with the driving means.

4. An improved attache case as claimed in claim 1 wherein said driving means comprising a reversible motor having a gear mounted on the rotation axis thereof for engaging with the teeth of the gear track to drive the drawer apparatus.

5. An improved attache case as claimed in claim 1 wherein said driving means comprising a plurality of springs attached to the drawer apparatus, a hook plate having a hook tip grasping the drawer apparatus mounted on an U-shaped frame by a pin passing through the opening on the hook plate, and a driving rod with one end thereof formed into a push botton and the other end in touch with the hook plate to be operated to control the hook plate.

6. An attache case comprising a base, a cover hinged to said base, a drawer apparatus provided in a chamber of said cover and a driving means also provided in said chamber of the cover to engage with the drawer apparatus for controlling the moving of the drawer apparatus, the driving means including a plurality of springs attached to the drawer apparatus, a hook plate having a hook tip grasping the drawer apparatus mounted on a U-shaped frame by a pin passing through an opening in the hook plate, and a driving rod with one end thereof formed into a push button and the other end in touch with the hook plate, said driving rod being operated to control the hook plate.

* * * * *